United States Patent [19]

Wegel et al.

[11] Patent Number: 4,813,661

[45] Date of Patent: Mar. 21, 1989

[54] ALIGNING DEVICE FOR SHEET DELIVERIES OF PRINTING PRESSES

[75] Inventors: Erich Wegel, Offenbach; Herbert Rebel, Rodbau, both of Fed. Rep. of Germany

[73] Assignee: M.A.N. Roland, Offenbach am Main, Fed. Rep. of Germany

[21] Appl. No.: 57,790

[22] Filed: Jun. 2, 1987

[30] Foreign Application Priority Data

Jun. 3, 1986 [DE] Fed. Rep. of Germany ..... 3618623

[51] Int. Cl.[4] ..... B65H 29/04

[52] U.S. Cl. ..... 271/204; 271/224

[58] Field of Search ..... 271/207, 220, 223, 224, 271/204

[56] References Cited

U.S. PATENT DOCUMENTS

| | | | |
|---|---|---|---|
| 2,957,691 | 10/1960 | Williams | 271/224 X |
| 3,847,386 | 11/1974 | Kruse | 271/223 X |
| 3,907,128 | 9/1975 | Cathers | 271/224 X |
| 4,364,553 | 12/1982 | Wilson | 271/207 X |
| 4,452,442 | 6/1984 | Geschwindner et al. | 271/224 X |
| 4,479,645 | 10/1984 | Pollich | 271/204 X |

FOREIGN PATENT DOCUMENTS

| | | | |
|---|---|---|---|
| 1181132 | 11/1964 | Fed. Rep. of Germany | 271/224 |
| 2022563 | 11/1971 | Fed. Rep. of Germany | 271/220 |

OTHER PUBLICATIONS

I.B.M. Technical Disclosure Bulletin, vol. 7, No. 8; Jan. 1965.

*Primary Examiner*—Joseph J. Rolla
*Assistant Examiner*—Gregory L. Huson

[57] ABSTRACT

An aligning device for sheet deliveries of printing presses which includes fixed sheet stops for the front edge of the delivery stack, fixed sheet stops for the back edge of the delivery stack, and movable brush sheet stops for the back edge of the delivery stack having a sheet brake disposed thereon oriented transverse to the direction of sheet movement. The brush sheet stops comprising one or more recessed brushes having firm bristles which are directed at a forwardly and downwardly inclined angle.

2 Claims, 3 Drawing Sheets

ALIGNING DEVICE FOR SHEET DELIVERIES OF PRINTING PRESSES

FIELD OF THE INVENTION

The invention relates to an aligning device for sheet deliveries of printing presses.

BACKGROUND OF THE INVENTION

A device for aligning sheets in the delivery section of printing presses is known from DE-OS No. 3127 540. A disadvantage of the device of this prior disclosure is that since the brushes are disposed on both sides in the sheet delivery, alignment relative to the front edge is bound to be uncertain because of the lateral recoil of the bristles previously carried along by sheets to be deposited. Also, the sheet may be hampered, on both sides, from dropping through freely. Another disadvantage is the expensive drive necessary to rotate the lateral brushes.

OBJECTS AND SUMMARY OF THE INVENTION

A primary object of the present invention is to provide a simple device which can provide accurately determined stack front edges even though the sheet size may vary somewhat.

According to the present invention there is provided an aligning device for sheet deliveries of printing presses which includes fixed sheet stops for the front edge of the delivery stack, fixed sheet stops for the back edge of the delivery stack, and movable brush sheet stops for the back edge of the delivery stack having a sheet brake disposed thereon oriented transverse to the direction of sheet movement. The brush sheet stops comprise one or more recessed brushes, which have firm bristles which are directed at a forwardly and downwardly inclined angle.

The primary advantage of the invention resides in improving the formation of stack front edges in the sheet delivery of printing presses. The stack front edge thus defined will hereinafter be called the contact edge.

These and other features and advantages of the invention will be more readily apparent upon reading the following description of a preferred, exemplified embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENTS

Figure 1:
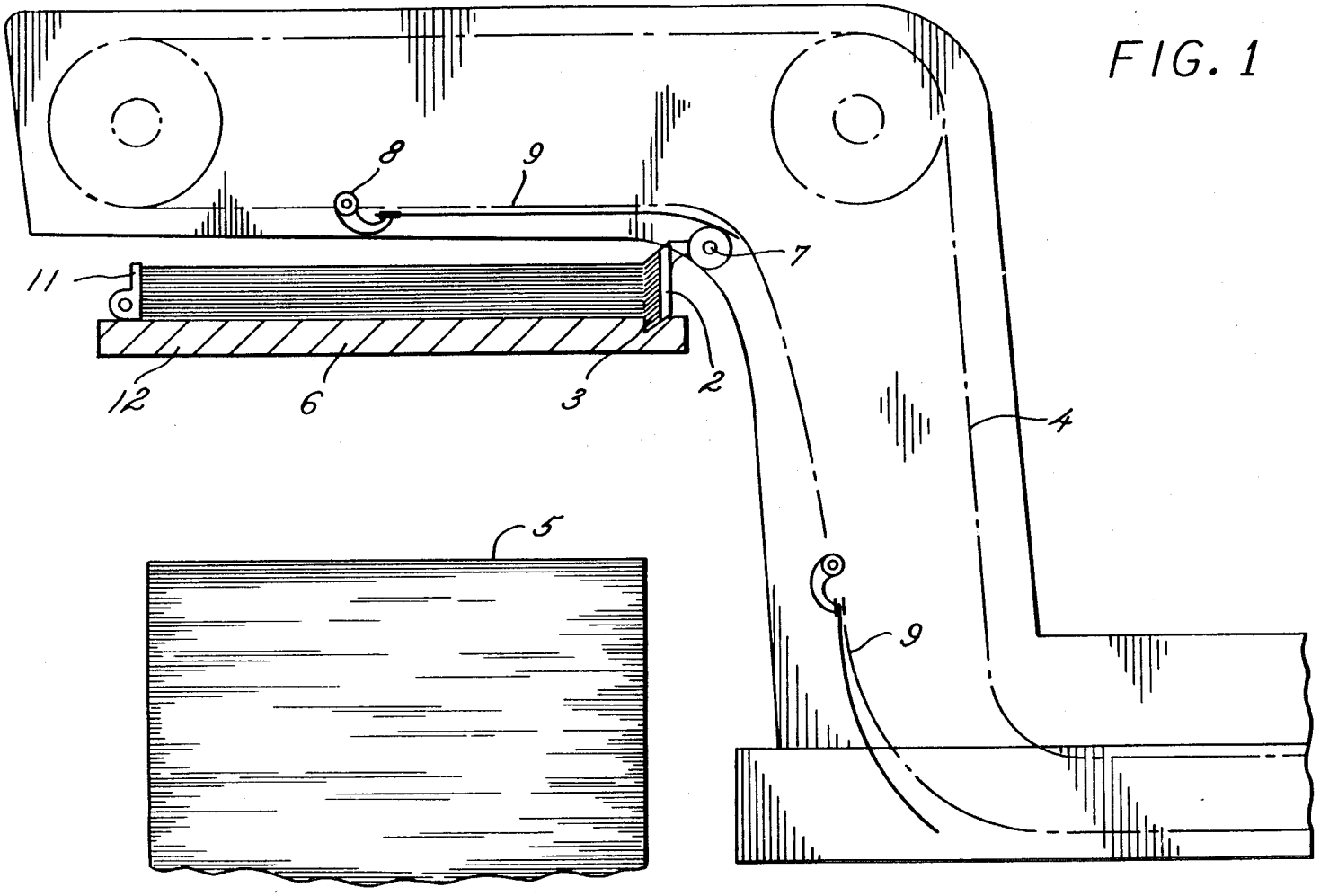
FIG. 1 is a somewhat schematic sectional view of a novel stacker for a printing press.

Referring to FIG. 1, printed sheets 9 are brought by sheet grippers 8 on chain conveyors 4 above an intermediate delivery stack 6 and deposited on an auxiliary delivery table 12 slidably mounted in channel-shaped side rails or bars 15, 16 suitably supported by the machine frame. Separate means may be provided (but are not shown here) for transferring the sheets 9 from the intermediate stack 6 to a main stack 5.

Figure 2:
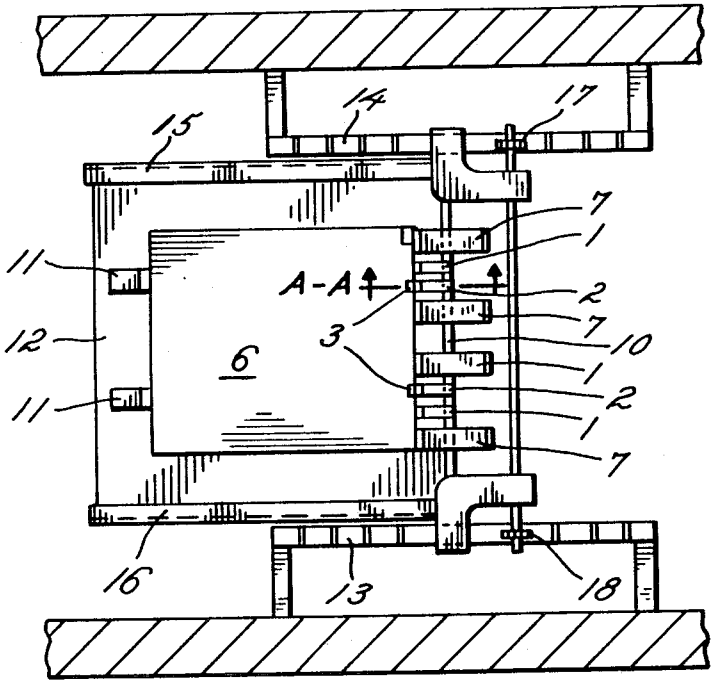
FIG. 2 is a partially sectioned plan view of the stacker of FIG. 1.
Figure 3:
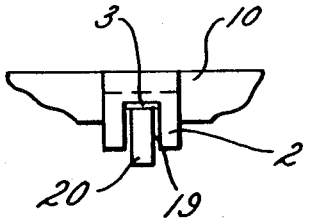
FIG. 3 is an enlarged, fragmentary view of one of the brushes of the present invention.
Figure 4:
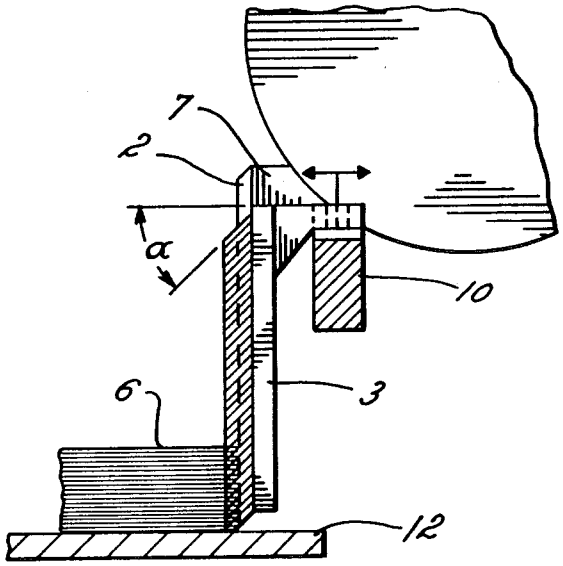
FIG. 4 is a still further enlarged sectional view of the brush of this invention taken substantially along the line A—A of FIG. 2.

After the strippers 8 on the chain conveyors 4 have opened, the sheets 9 are braked by a sheet brake 7 adjacent the back-edge of the stack 6 and aligned against front-edge sheet stops 11. A cross member 10 for the brake 7 is oriented transversely to the direction of sheet movement (FIG. 2). Fixed sheet stops 1 and 2 are provided for the back edges of the sheets 9. Pursuant to the invention, brushes 3 are mounted in recesses 19 associated with the fixed sheet stops 2 for the back edge of the sheet 9 (FIGS. 3–4). The brushes 3 have firm bristles 20, which are disposed at a forwardly and downwardly inclined angle $\alpha$ of, preferably, at least 30° (FIG. 4).

In accordance with the invention, the sheets 9 are aligned accurately against the front-edge stops 11 even when, for cost reasons, sheets differing in size, for example, by 3 mm and more, have to be dealt with. Short sheets 9 drop through freely past the bristles 20 whereas long sheets 9 must overcome the resilient resistance of the bristles on the brushes 3. Preferably, the length and strength of the bristles 20 and their angle of inclination are selected such that the sheets 9 do not stick in the bristles 20 although adequate forward thrust to urge the sheets against the front-edge stops 11 is provided. Thus, the brushes 3 are arranged to accommodate this difference in sheet size by positioning the brushes so that the distance between the tips of the bristles 20 and the fixed front-edge sheet stops 11 is somewhat less than the longest sheets to be stacked. The depth to which the bristles penetrate into the rear edge of the stack 6 is adjustable by moving the cross member 10 closer to or further away from the fixed front-edge stops 11, as indicated by arrows in FIG. 4, thereby moving longitudinally the bristles which are connected to cross member 10 through brushes 3 and fixed sheet stops 2.

To accommodate sheets 9 of different sizes and formats, the brake 7 together with the back-edge stops 1, 2 and the brushes 3 are adapted to move on guide rods 13, 14 in the direction of sheet movement. Displacement of the brake 7 may be provided by rotation of pinion gears 17, 18 which cooperate with rack-like teeth on longitudinally spaced side bars or rods 13, 14.

It will be appreciated, of course, that the solution of the problem which the invention provides is not limited to the embodiment described with an auxiliary delivery table 12 but is suitable for use with any kind of sheet stackers in order to form a neat stack between fixed stops when sheets of different sizes are being dealt with.

We claim as our invention:

1. An auxiliary device for aligning sheets in a stacking arrangement in preparation for their delivery to printing presses and the like comprising:

fixed sheet stops for the front edge of the delivery stack to arrest the forward sheet movement and against which the sheets are to be stacked;

fixed sheet stops for the back edge of the delivery stack having a sheet brake disposed thereon, said sheet brake oriented transverse to the direction of the sheet movement; and movable brush sheet stops for the back edge of the delivery stack disposed adjacent to said fixed back-edge sheet stops and transverse to the direction of sheet movement, said movable brush sheet stops including brushes disposed in recesses in said back-edge stops, and said brushes having firm bristles which are directed at a forwardly and downwardly inclined angle alpha ($\alpha$), whereby said bristles, not only guide the sheets forward against said fixed front-edge sheet stops, but also arrest any upward or backward rebound of the sheets once they have been delivered against said fixed front-edge sheet stops.

2. An auxiliary device according to claim 1, wherein said angle is about 30 degrees from the horizontal.

* * * * *